US006721425B1

(12) United States Patent
Aylward

(10) Patent No.: US 6,721,425 B1
(45) Date of Patent: Apr. 13, 2004

(54) SOUND SIGNAL MIXING

(75) Inventor: J. Richard Aylward, Ashland, MA (US)

(73) Assignee: Bose Corporation, Framingham, MA (US)

( * ) Notice: Subject to any disclaimer, the term of this patent is extended or adjusted under 35 U.S.C. 154(b) by 569 days.

(21) Appl. No.: 09/122,988

(22) Filed: Jul. 27, 1998

Related U.S. Application Data

(63) Continuation of application No. 08/796,285, filed on Feb. 7, 1997.

(51) Int. Cl.[7] ..... H04R 5/00

(52) U.S. Cl. ..... 381/22; 381/17; 381/18; 381/23; 381/307

(58) Field of Search ..... 381/22–23, 307, 381/17–21, 119–120

(56) References Cited

U.S. PATENT DOCUMENTS 5,579,396 A * 11/1996 Iida et al. ..... 381/18

FOREIGN PATENT DOCUMENTS

JP 54123902 9/1979
JP 06165079 10/1994
WO 98/20709 5/1998

* cited by examiner

*Primary Examiner*—Duc Nguyen
(74) *Attorney, Agent, or Firm*—Fish & Richardson P.C.

(57) ABSTRACT

A method of down mixing a plurality of signals including at least a left surround signal, a right surround signal, a left signal and a right signal into a stereophonic pair that is a left transmitted signal and a right transmitted signal includes summing the left surround and right surround signals to provide a monophonic surround signal, filtering the monophonic surround signal to provide a filtered monophonic signal having properties related to the diffraction pattern around the head of a listener, multiplying the filtered monophonic surround signal with a right coefficient signal related to the ratio of the magnitude of the right surround signal to the sum of the magnitudes of the left surround signal and the right surround signal to provide a left product signal and multiplying the filtered monophonic surround signal with a left coefficient signal related to the ratio of the magnitude of the left surround signal to the sum of the magnitudes of the left surround signal and the right surround signal to provide a right product signal, combining signals related to the left product signal and the left front signal to provide the left transmitted signal, and combining signals related to the right product signal and the right front signal to provide the right transmitted signal.

11 Claims, 9 Drawing Sheets

SOUND SIGNAL MIXING

This application is a continuing application of U.S. application Ser. No. 08/796,285, filed Feb. 7, 1997, entitled SURROUND SOUND CHANNEL ENCODING AND DECODING.

The present invention relates in general to surround sound decoding and more particularly concerns novel apparatus and techniques for down-mixing a variable number of channels into a conventional stereophonic left and right channel pair, which when reproduced as a stereophonic pair, preserves the directional information of the originating left and right channel surround signals.

A typical surround sound signal includes at least left front, center front, right front, left rear, and right rear signals. A typical approach combines these signals into two signals that are typically decoded to recover a left front signal, a right front signal, a center signal and a monophonic rear signal representative of the sum of the original left rear and right rear signals.

It is an important object of the invention to provide improved apparatus and techniques for processing surround signals.

A feature of the invention resides in down-mixing a variable number of channels into a conventional stereophonic left and right channel pair which, when reproduced as a stereophonic pair, preserves the directional information of the originating left and right channel surround signals (also referred to as the left and right rear channel signals). Another feature resides in providing backward compatibility with existing matrix surround-sound decoder technologies such that the decoder technologies can substantially retrieve the encoded surround channel signals and their respective directional information.

The down-mixing apparatus typically includes a summer for summing the originating left and right channel surround signals into a single monophonic pair, level detectors for providing absolute value signals representative of the absolute values of the magnitudes of the originating left and right channel surround signals time averaged. A filter is coupled to the output of the summer and is constructed and arranged to filter the monophonic sum signal and typically having a single real pole in the transfer characteristic at a frequency of about 2 kHz and a single real zero at a frequency of about 1 kHz. There may be a pair of variable gain elements constructed and arranged to multiply the filtered sum signal by first and second time varying coefficient signals A1 and A2, respectively. The first coefficient signal is representative of the time averaged magnitude of the right channel surround signal divided by the sum of the time averaged magnitude of the left channel surround signal plus the time averaged magnitude of the right channel surround signal. The second coefficient is representative of the time averaged magnitude of the left channel surround signal divided by the sum of the time average magnitude of the left channel surround signal plus the time average magnitude of the right channel surround signal. The first and second multipliers provide first and second output product signals respectively $H_{sA1}$, and $H_{sA2}$. A subtractor subtracts the time varying product signals $H_{sA1}$, and $H_{sA2}$ from the unfiltered monophonic sum signal to produce the two encodable signals 1-$H_{sA1}$ and 1-$H_{sA2}$, respectively. These two encodable signals are then typically combined with a front center signal and at least respective ones of left and right signals to provide a stereo pair comprising left and right transmitted signals LT and RT, respectively, that may be coupled to left and right loudspeakers, respectively, to provide a transduced surround signal that reproduces components perceived by a listener as including directional information in the left and right surround signals.

An important aspect of the invention resides in providing time varying representations of the left and right surround signals, typically of magnitude that may be normalized magnitude relative to the sum of their magnitudes, and combining these time varying representations with at least left front and right front signals to provide the stereophonic pair.

Other features, objects and advantages of the invention will become apparent from the following detailed description when read in connection with the accompanying drawings in which.

Figure 1:
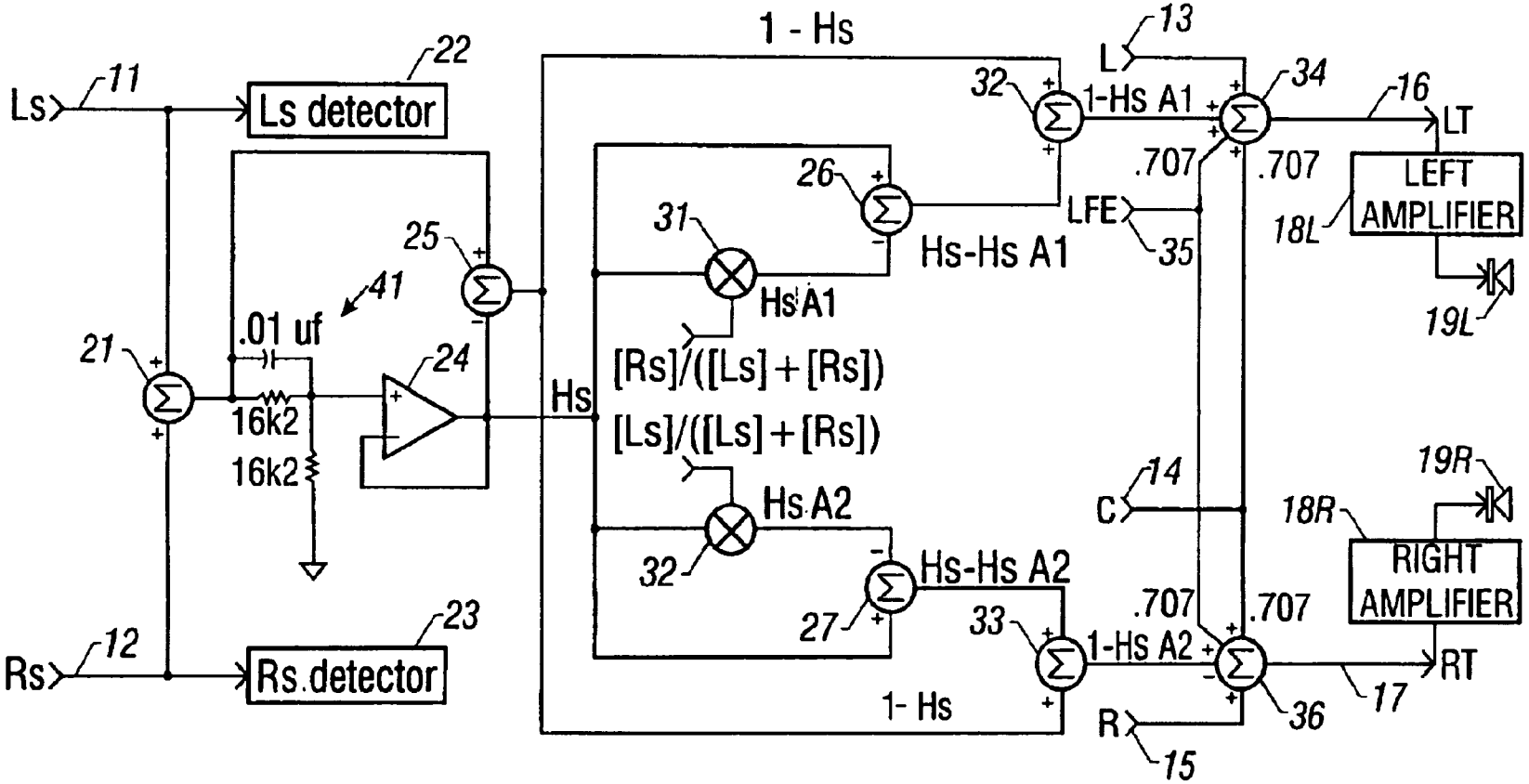
FIG. 1 is a block diagram illustrating the logical arrangement of an embodiment of the invention having matrix encode with split surround channels and a first-order head shading filter.

With reference now to the drawings and more particularly to FIG. 1 thereof, there is shown a block diagram illustrating the logical arrangement of a matrix encode with split surround channels and head shading filter in accordance with the invention. The apparatus combines the left surround, right surround, left front, center front, and right front signals on left surround input 11 right surround input 12, left input 13, center input terminal 14, and right input 15, respectively, to provide left transmitted and right transmitted signals forming a stereophonic pair for transmission on LT output 16 and RT output 17 that retain the directional information carried by the left and right surround signals. The left surround input 11 and right surround input 12 are coupled to combiner 21 for cumulatively combining the surround signals and are respectively coupled to Ls detector 22 and Rs detector 23 to provide signals on their respective outputs representative of the magnitudes of the left surround and right surround signals respectively, [Ls] and [Rs].

The output of combiner 21 is coupled to the +input of differential amplifier 24 whose output is coupled to its − input, the − input of combiner 25, the + input of combiner 26, the + input of combiner 27 and an input of left multiplier 31 and right multiplier 32. The output of combiner 21 is also coupled to the + input of combiner 25. The output of combiner is coupled to a + input of left intermediate combiner 32 and right intermediate combiner 33.

The other input of left multiplier 31 receives a signal that is the ratio of the magnitude of the right surround signal Rs to the sum of the magnitudes of the left surround signal Ls and the right surround signal Rs to provide a product signal delivered to the − input of left input combiner 26. The right multiplier 32 receives a signal related to the ratio of the magnitude of the left surround signal Ls to the sum of the magnitudes of the left and right surround signals Ls and Rs to provide a product signal that is delivered to the − input of right input combiner 27.

The output of left input combiner 26 is coupled to a + input of left intermediate combiner 32. The output of right input combiner 27 is coupled to a + input of right intermediate combiner 33. The left output combiner 34 has a + input coupled to left input 13, the output of left intermediate combiner 32, the LFE input 35 and the center input 14. (What is the LFE signal?)

The right output combiner 36 has + inputs coupled to right input 15, LFE input 35 and center input 14 and a − input coupled to the output of right intermediate combiner 33. The outputs of left and right output combiners 34 and 36 are coupled to left transmitted and right transmitted outputs 16 and 17, respectively.

The left and right transmitted outputs LT 16 and RT 17 energized left and right amplifiers 18L and 18R, respectively. Left and right amplifiers 18L and 18R energize left and right loudspeakers 19L and 19R, respectively, to reproduce surround sound perceived by a listener as having directional properties characterized by the left surround and right surround signals Ls and Rs.

The output of $L_s$ detector 22 and $R_s$ detector 23 are added to form the sum of the magnitudes $[L_s]+[R_s]$ and the output of $R_s$ detector 23 divided by this sum signal to provide the input to the left multiplier 31. The output of $L_s$ detector 22 is divided by this sum signal to provide the multiplier signal applied to right multiplier 32.

Figure 2:
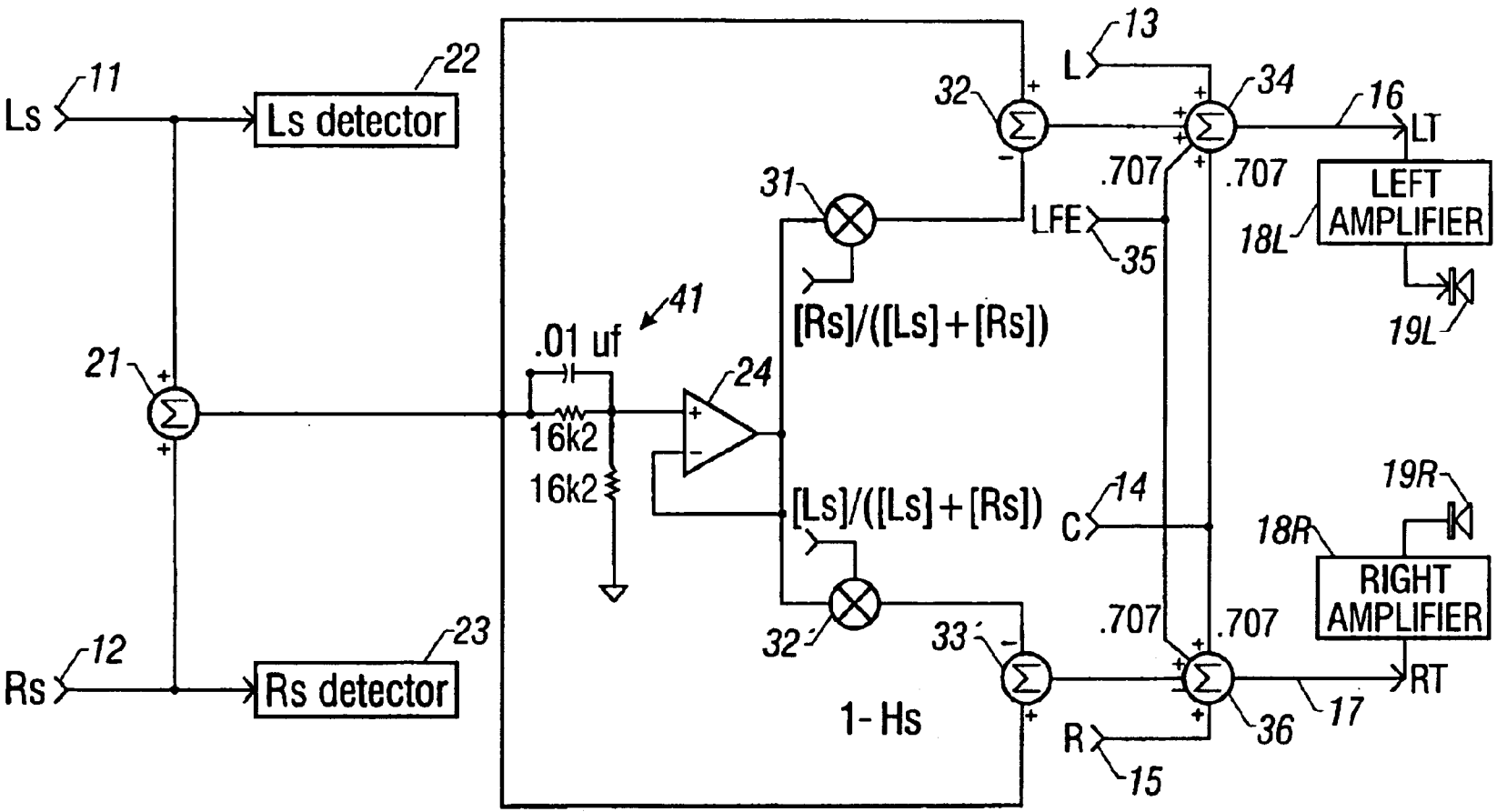
FIG. 2 is a block diagram of another embodiment of the invention.

Referring to FIG. 2, there is shown another embodiment of the invention that uses fewer components. Corresponding elements are identified by the same reference symbols throughout the drawings. This embodiment of the invention omits combiners 25, 26 and 27, and the outputs of multipliers 31 and 32 are coupled to − inputs of intermediate combiners 32', 33', respectively.

Both the embodiments of FIGS. 1 and 2 include the head shading filter 41 that intercouples the output of combiner 21 with the + input of differential amplifier 24.

Figure 3:
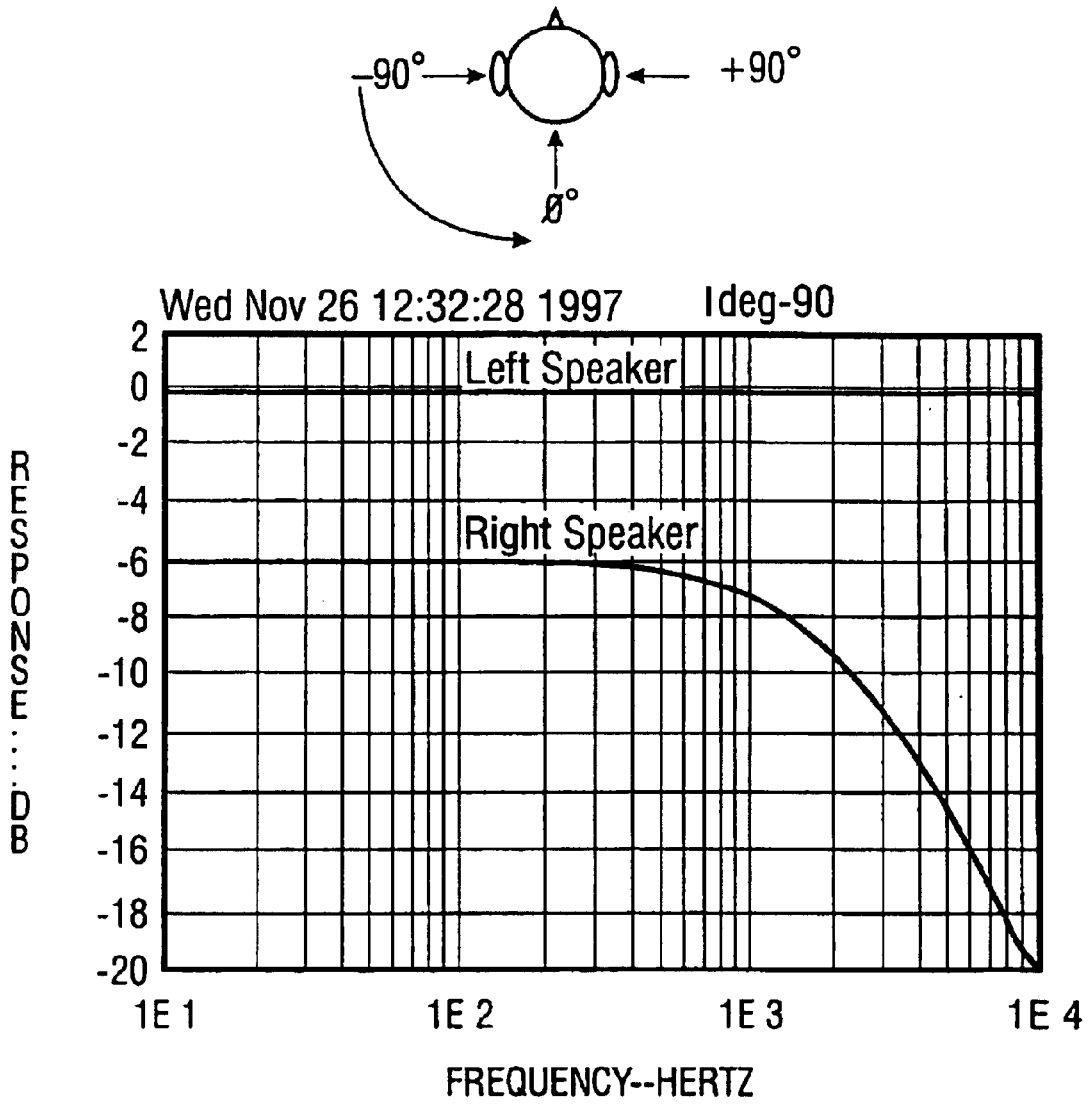
FIG. 3 is a graphical representation of left speaker and right speaker frequency responses effectively introduced by the head shading filter for an angle of incidence of −90 degrees.

Referring to FIG. 3, there is shown an effect of the head shading filter with a plan view of the head at the top and angles of incidence of sound waves from −90° incident on the left ear to +90° incident on the right ear and 0° incident on the back of the head. FIG. 3 shows the effective frequency response for sound energy incident at −90° with the effective frequency response of the left speaker being substantially uniform and that of the right speaker down by substantially −6 dB through about 1 kHz and falling off to −20 dB at 10 kHz.

Figure 4:
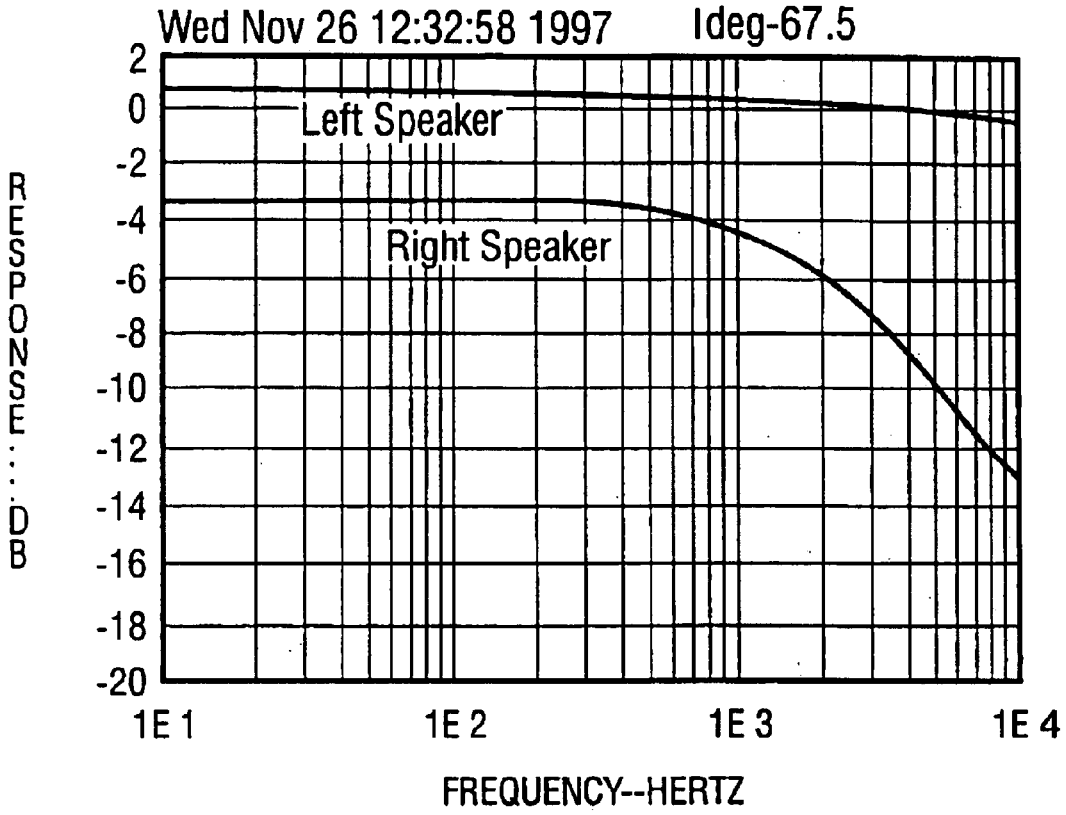
FIGS. 4–7 show similar frequency response characteristics for angles of incidence of −67.5°, −45°, −22.5° and 0°, respectively.

FIG. 4 shows the respective effective responses for sound incident at an angle at −67.50 with the left speaker about 0.5 dB up through about 2 kHz and back to 0 to 10 kHz. The effective response of the right speaker is down about 3.5 dB to about 600 Hz and progressively reduces to just below 12 dB down at 10 kHz.

Figure 5:
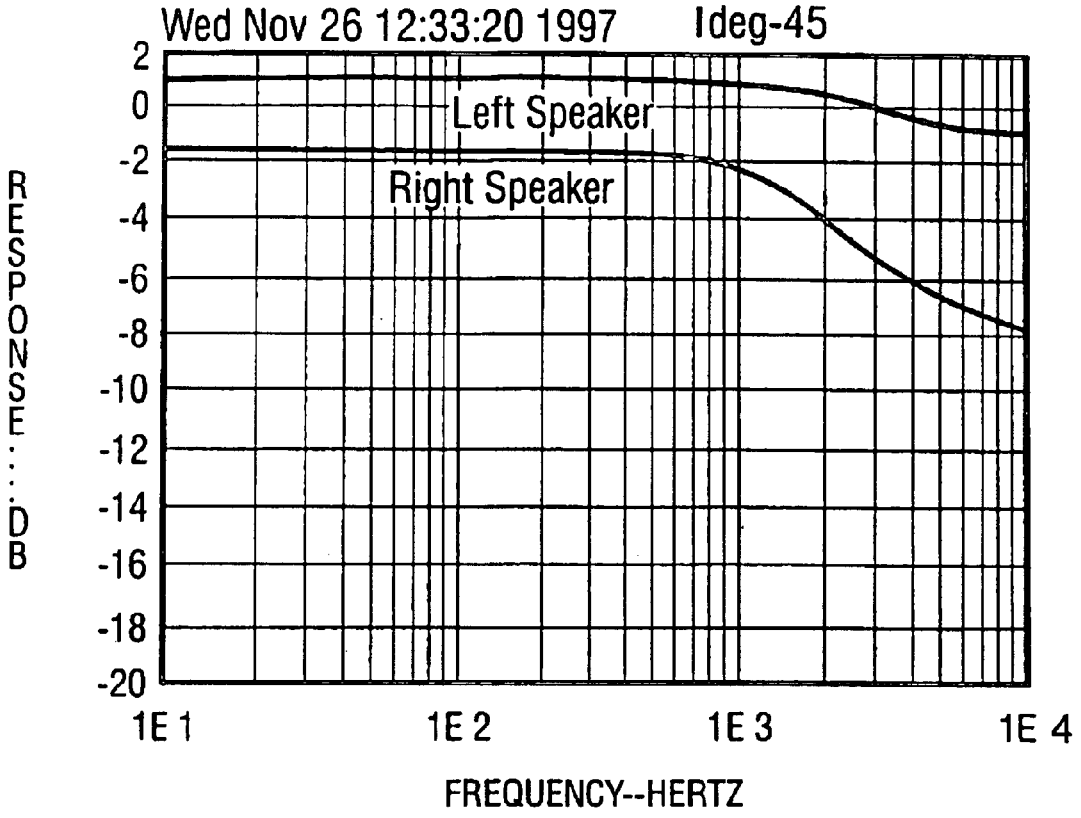

Referring to FIG. 5, for sound energy incident at an angle of −45°, the effective response of the left speaker is up about a dB through 1 kHz and gradually decreases to about 0.5 dB at 10 kHz. The effective response of the right speaker is down about 1.5 dB through about 500 Hz and decreases to almost 8 dB down at 10 kHz.

Figure 6:
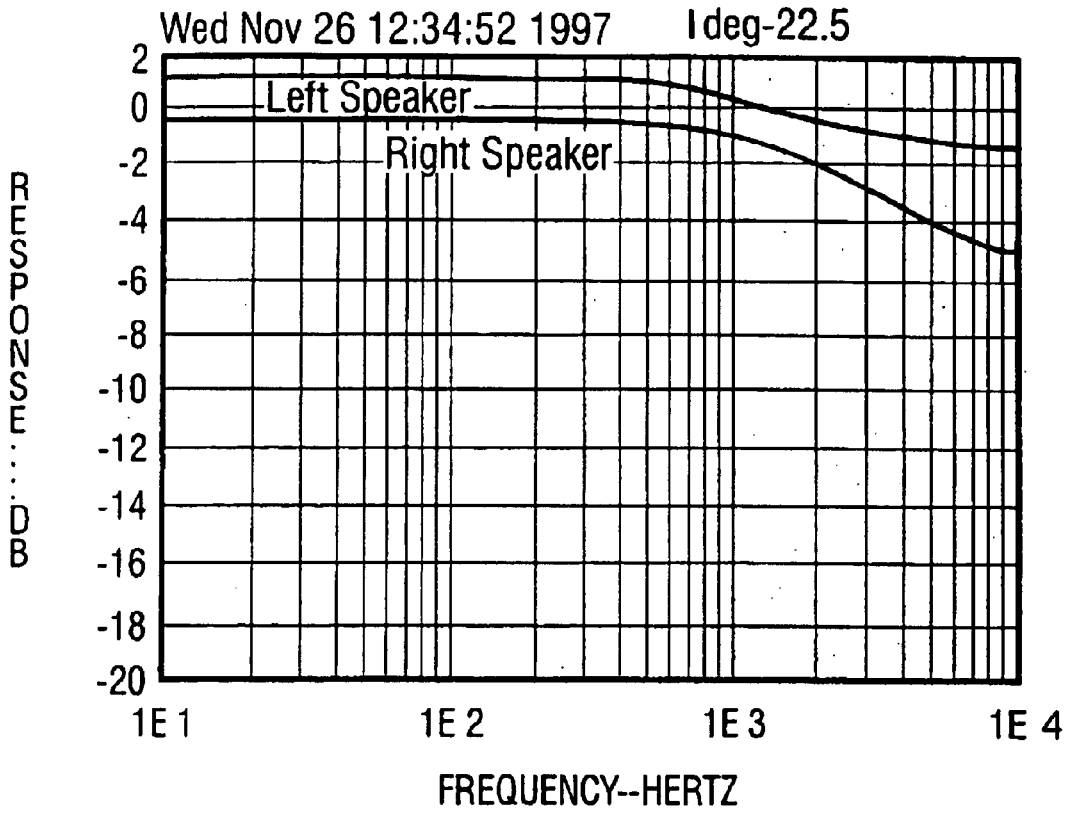

Referring to FIG. 6, for sound energy incident at an angle of −22.5°, the left speaker is up about a dB through 1 kHz and gradually decreases to down about 1.5 dB at 10 kHz.

The right speaker is just below 0 dB to about 500 Hz and gradually decreases to about 5 dB down at 10 kHz.

Figure 7:
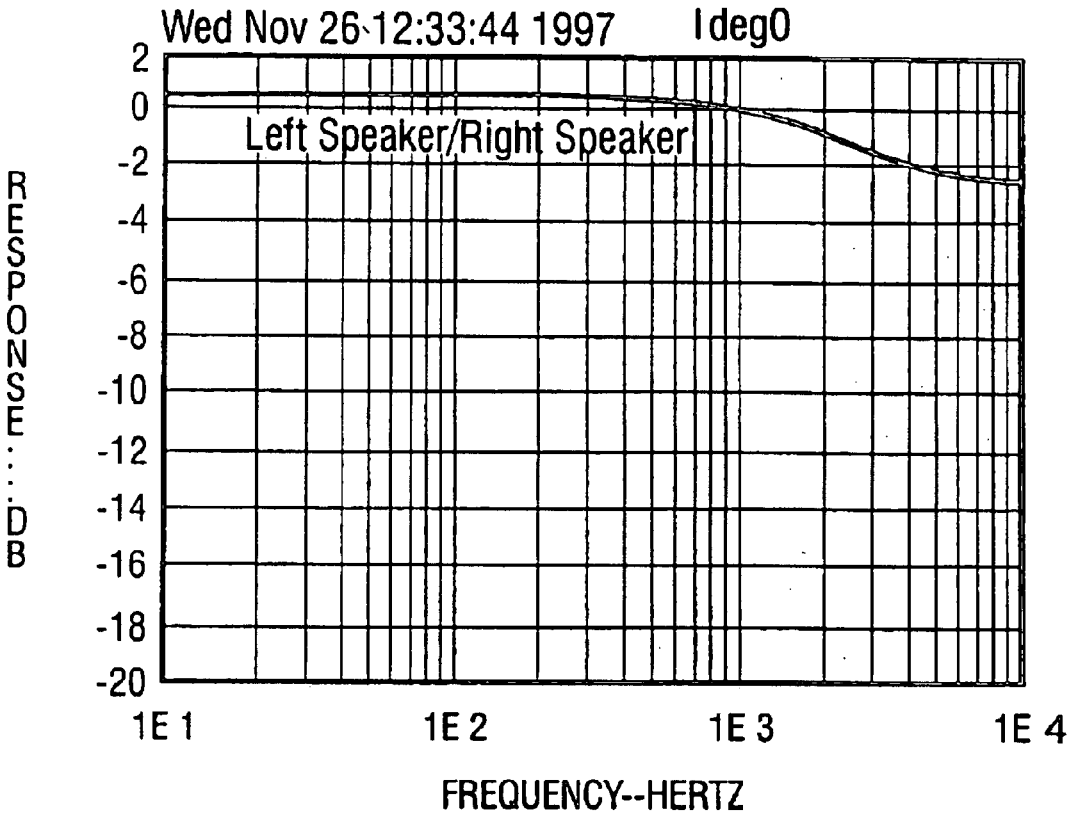

Referring to FIG. 7, for sound energy incident at 0°, the effective responses for the left speaker and the right speaker are the same and slightly above 0 dB to 1 kHz and gradually decrease to just below 2 dB down at 10 kHz.

The head shading filter 41 typically has a single real pole at 2 kHz and a single real zero at 1 kHz to coact with the remaining system components to effectively achieve the frequency responses shown in FIGS. 3–7 for rear surround information carried by the left and right surround signals on inputs 11 and 12.

Figure 8:
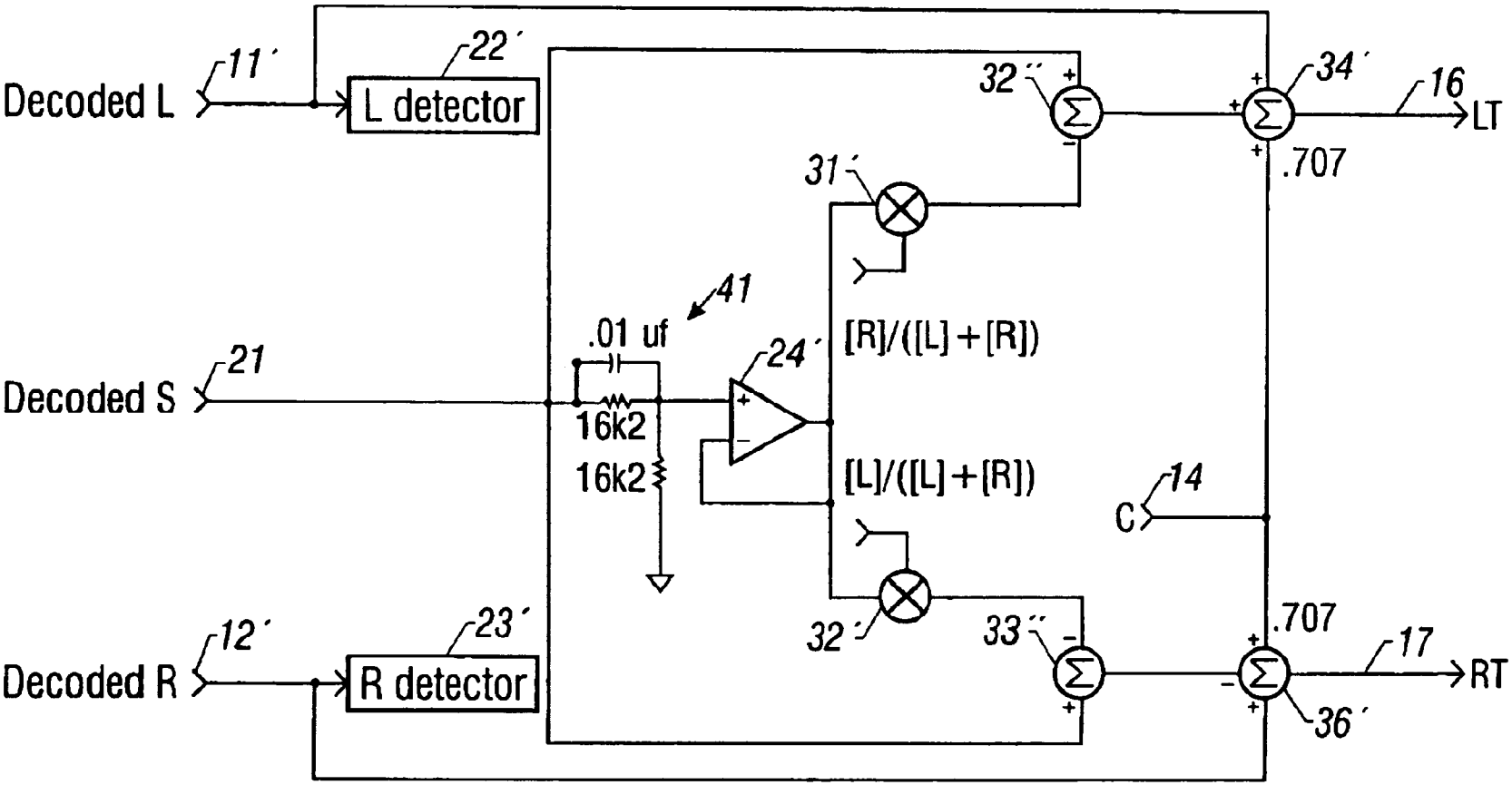
FIG. 8 is a block diagram illustrating the logical arrangement of an embodiment of the invention having modified matrix re-encode for use with a conventional monaural sound decoder and first-order head shading filter.

Referring to FIG. 8, there is shown a block diagram illustrating the logical arrangement of another embodiment of the invention of a modified matrix re-encoder for use with a conventional monaural surround decoder and first-order head shading filter. A decoded L signal on input 11' energizes L detector 22' and one input of left output signal combiner 34'. The decoded R signal on input 12' energizes R detector 23' and one input of right output signal combiner 36'. The decoded S signal on input 21 energizes operational amplifier 24' through network 41. The output of operational amplifier 24' energizes one input of left multiplier 31' and one input of right multiplier 32'. The other input of left multiplier 31' receives a signal corresponding to the ratio of the magnitude of the right input signal R provided by R detector 23' to the sum of the magnitudes of the decoded left signal L and decoded R signal provided by adding the outputs of L detector 22' and R detector 23'. The other input of right multiplier 32' receives a signal corresponding to the ratio of the magnitude of the decoded left signal L to the sum of the magnitudes of the decoded L and decoded R signals provided by adding the outputs of L detector 22' and R detector 23'. The left product signal from left multiplier 31' is differentially combined with the decoded S signal on input 21 in input combiner 32" to provide an output that energizes a second input of left output signal combiner 34'. The right product signal from right multiplier 32' is differentially combined with the decoded S signal on terminal 21 in right input combiner 33' to provide a signal that energizes the— input of right output signal combiner 36'. The third input of signal combiners 34' and the 36' receive the center C signal on input 14 to provide the LT and RT signals, respectively, on lines 16 and 17, respectively.

Figure 9:
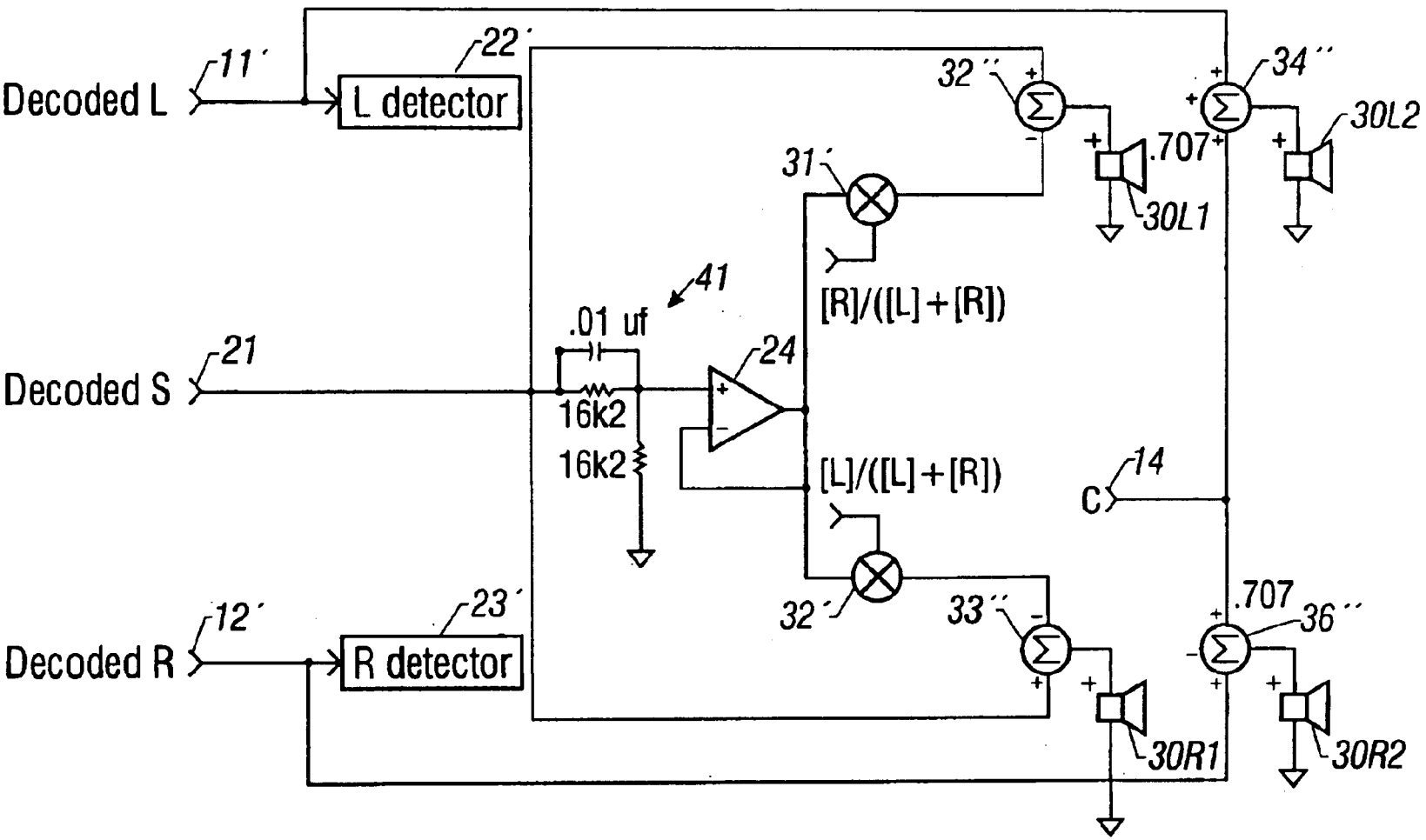
FIG. 9 is a modified block diagram of the embodiment of FIG. 8 in which signals are acoustically combined to provide sound signals characteristic of LT and RT.

Referring to FIG. 9, there is shown a modified block diagram of the embodiment of FIG. 8 in which signals are acoustically combined to provide sound signals representative of the left transmitted signal LT and the right transmitted signal RT. Corresponding elements are identified by the same reference symbols in FIGS. 8 and 9, and only the differences will be described.

Instead of the output of left input combiner 32" and right input combiner 33" being applied to inputs of left output signal combiner 34' and right signal output combiner 36', these outputs are coupled to a first left loudspeaker driver 30L1 and a first right loudspeaker driver 30R1, respectively. The output of left output signal combiner 34" and right output signal combiner 36" are coupled to a second left loudspeaker driver 30*a*L2 and a second right loudspeaker driver 30R2, respectively. Left output signal combiner 34" and right output signal combiner 36" only combine the center signal on line 14 with the decoded L signal on terminal 11' and the decoded R signal on terminal 12', respectively. The loudspeaker drivers thus perform an acoustical combination in the system of FIG. 9 that is the equivalent of the electrical combination performed by left output signal combiner 34' and right output signal combiner 36' in FIG. 8.

There has been described novel apparatus and techniques for down-mixing a variable number of channels into a conventional stereophonic left and right channel pair which, when reproduced as a stereophonic pair, preserves the directional information of the originating left and right channel surround signals while simultaneously providing backward compatibility with existing matrix surround-sound decoder technology such that conventional surround sound decoders can substantially retrieve the encoded surround channel signals and their respective directional information. It is evident that those skilled in the art may now make numerous uses and modifications of and departures from the specific apparatus and techniques disclosed herein without departing from the inventive concepts. Consequently, the invention is to be construed as embracing each and every novel feature and novel combination of features present in or possessed by the apparatus or techniques herein disclosed and limited solely by the spirit and scope of the appended claims.

What is claimed is:

1. A method of down mixing a plurality of signals including at least a left surround signal, a right surround signal, a left front signal and a right front signal into a stereophonic pair that is a left transmitted signal and a right transmitted signal including, summing the left surround and right surround signals to provide a monophonic surround signal, filtering the monophonic surround signal to provide a filtered monophonic signal having properties related to the diffraction pattern around the head of a listener, multiplying the filtered monophonic surround signal with a right coefficient signal related to the ratio of the magnitude of the right surround signal to the sum of the magnitudes of the left surround signal and the right surround signal to provide a left product signal and multiplying the filtered monophonic surround signal with a left coefficient signal related to the ratio of the magnitude of the left surround signal to the sum of the magnitudes of the left surround signal and the right surround signal to provide a right product signal, combining signals related to the left product signal and the left front signal to provide the left transmitted signal, and combining signals related to the right product signal and the right front signal to provide the right transmitted signal.

2. A method of down mixing a plurality of signals including at least a left surround signal, a right surround signal, a left front signal and a right front signal into a stereophonic pair that is a left transmitted signal and a right transmitted signal including, summing the left surround and right surround signals to provide a monophonic surround signal, filtering the monophonic surround signal to provide a filtered monophonic signal having properties related to the diffraction pattern around the head of a listener, multiplying the filtered monophonic signal with a right coefficient signal related to the magnitude of the right surround signal to provide a left product signal, multiplying the filtered monophonic signal with a left coefficient signal related to the magnitude of the left surround signal to provide right product signal, combining signals related to the left product signal and the left front signal to provide the left transmitted signal, and combining signals related to the right product signal and the right front signal to provide the right transmitted signal.

3. A method of down mixing a plurality of signals including a left front signal, a right front signal and a surround signal into a stereophonic pair that is a left transmitted signal and a right transmitted signal including, filtering the surround signal to provide a filtered monophonic signal having properties related to the diffraction pattern around the head of a listener, multiplying the filtered monophonic surround signal with a right coefficient signal related the ratio of the magnitude of the right signal to the sum of the magnitudes of the left signal and the right signal to provide a left product signal and multiplying the filtered monophonic signal with a left coefficient signal related to the ratio of the magnitude of the left signal to the sum of the magnitudes of the left signal and the right signal to provide a right product signal, combining signals related to the left product signal and the left front signal to provide the left transmitted signal, and combining signals related to the right product signal and the right front signal to provide the right transmitted signal.

4. Apparatus for downmixing a plurality of signals including at least a left surround signal, a right surround signal, a left front signal and a right front signal into a stereophonic pair that is a left transmitted signal and a right transmitted signal comprising, a summer having a left surround input and a right surround input for receiving the left surround signal and right surround signal respectively to provide a monophonic surround signal, a filter coupled to said summer for providing a filtered monophonic signal having properties related to the diffraction pattern around the head of a listener, a left multiplier having one input coupled to the filter and a second input constructed and arranged to receive a right coefficient signal related to the ratio of the magnitude of the right surround signal to the sum of the magnitudes of the left surround signal and the right surround signal to provide a left product signal, a right multiplier having one input coupled to the filter and another input constructed and arranged to receive a left coefficient signal related to the ratio of the magnitude of the left surround signal to the sum of the magnitudes of the left surround signal and the right surround signal to provide a right product signal, a left output combiner having an input coupled to the left multiplier constructed and arranged to receive the left product signal and another input constructed and arranged to receive the left front signal for providing the left transmitted signal, and a right output combiner having one input coupled to the right multiplier constructed and arranged to receive the right product signal and another input constructed and arranged to receive the right front signal for providing the right transmitted signal.

5. A method of downmixing a plurality of signals in accordance with claim 1 and further including detecting the magnitude of said left surround signal to provide a left surround magnitude signal, detecting the magnitude of said right surround signal to provide a right surround magnitude signal, combining said left surround magnitude signal and said right surround magnitude signal to form said right coefficient signal and said left coefficient signal, differentially combining the monophonic surround signal with the filtered monophonic signal to provide a differential monophonic signal, differentially combining the filtered monophonic signal with the left product signal to provide a left differential product signal, differentially combining the differential monophonic signal the right product signal to provide a differential right product signal, cumulatively combining the differential monophonic signal with the differential left product signal to provide a left cumulative signal, cumulatively combining the differential monophonic signal with the differential left product signal to provide a cumulative right product signal, cumulatively combining the left front signal with the left cumulative product signal to provide a component of the left transmitted signal, and cumulatively combining the right front signal with the right cumulative product signal to form a component of said right transmitted signal.

6. A method of downmixing a plurality of signals in accordance with claim 5 wherein said plurality of signals further includes a center front signal and further including, cumulatively combining said center front signal with said left front signal and said cumulative left product signal to form a component of said left transmitted signal, and cumulatively combining said center front signal and said right front signal while differentially combining said cumulative right product signal to form a component of said right transmitted signal.

7. A method of downmixing a plurality of signals in accordance with claim 1 and further including, detecting the magnitude of said left surround signal to provide a left surround magnitude signal, detecting the magnitude of said right surround signal to provide a right surround magnitude signal, combining said left surround magnitude signal and said right magnitude surround signal to provide said right coefficient signal and said left coefficient signal, differentially combining said left product signal with said monophonic signal to provide a differential left surround signal, differentially combining said right product signal and said monophonic surround signal to provide a differential right surround signal, cumulatively combining said left front signal and said differential left product signal to provide a component of said left transmitted signal, and differentially combining said differential right product signal with said right front signal to provide a component of said right transmitted signal.

8. A method of downmixing a plurality of signals in accordance with claim 7 wherein said plurality of signals also include a center front signal and further including, cumulatively combining said center front signal with said left front signal and said differential left surround signal to form a component of said left transmitted signal, and cumulatively combining said center front signal with said right front signal differentially combined with differential right product signal to form a component of said right transmitted signal.

9. A method of downmixing a plurality of signals including at least a left surround signal, a right surround signal, a left front signal and a right front signal into a stereophonic pair that is a left transmitted signal and a right transmitted signal including, summing the left surround and right surround signals to provide a monophonic surround signal, filtering the monophonic surround signal to provide a filtered monophonic signal having properties related to the diffraction pattern around the head of a listener, and multiplying the filtered monophonic surround signal with a time varying coefficient signal related to the surround signals.

10. A method of downmixing a plurality of signals in accordance with claim 1 wherein said coefficient signal is related to the magnitude of the larger of the magnitudes of said left and right surround signals.

11. A method of downmixing a plurality of signals in accordance with claim 1 wherein the steps of combining signals relating to the left product signal and the left front signal and combining signals related to the right product signal and the right front signal is performed acoustically to provide the left and right transmitted signals as left transmitted sound signals and right transmitted sound signals respectively.

* * * * *